US008015626B2

(12) United States Patent
Grassl et al.

(10) Patent No.: US 8,015,626 B2
(45) Date of Patent: Sep. 13, 2011

(54) SAFETY HELMET WITH MODULE RING

(75) Inventors: Thomas Grassl, Lübeck (DE); Axel Freitag, Unterbalbach (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 1076 days.

(21) Appl. No.: 11/383,588

(22) Filed: May 16, 2006

(65) Prior Publication Data

US 2007/0022520 A1 Feb. 1, 2007

(30) Foreign Application Priority Data

May 27, 2005 (DE) ..... 10 2005 024 507

(51) Int. Cl.
*A42B 1/24* (2006.01)
*A42B 1/06* (2006.01)
*F41H 1/04* (2006.01)

(52) U.S. Cl. ..... 2/422; 2/410; 2/6.6

(58) Field of Classification Search ..... 2/410, 5, 2/6.1, 6.2, 6.6, 6.7, 6.8, 421, 422, 425, 10, 2/452; 434/27; D2/866, 895; 224/181, 182
See application file for complete search history.

(56) References Cited

U.S. PATENT DOCUMENTS

| | | | | | |
|---|---|---|---|---|---|
| 725,524 | A | * | 4/1903 | Wetmore | 2/209.13 |
| 1,723,276 | A | * | 8/1929 | Gottlieb | 224/181 |
| 1,901,180 | A | * | 3/1933 | McBride | 362/105 |
| 2,113,779 | A | * | 4/1938 | Williamson | 128/201.27 |
| 2,209,609 | A | * | 7/1940 | Odom | 43/57.1 |
| 2,597,601 | A | * | 5/1952 | Sherman | 43/57.1 |
| 2,728,913 | A | * | 1/1956 | Connor | 2/10 |
| 2,769,272 | A | * | 11/1956 | Goldman | 446/27 |
| 3,273,163 | A | | 9/1966 | Andrews, III | |
| 3,375,529 | A | * | 4/1968 | Timm et al | 2/8.1 |
| 3,613,115 | A | * | 10/1971 | Hill | 2/10 |
| 3,781,915 | A | * | 1/1974 | Menold et al. | 2/10 |
| 4,193,133 | A | * | 3/1980 | Laibach et al. | 2/10 |
| 4,547,908 | A | * | 10/1985 | Karlsson et al. | 2/424 |
| 4,729,499 | A | * | 3/1988 | Martin | 224/181 |
| 4,958,264 | A | * | 9/1990 | Evendon | 362/106 |
| 5,553,327 | A | * | 9/1996 | Koecher et al. | 2/200.3 |
| 5,608,919 | A | | 3/1997 | Case | |
| 5,638,544 | A | * | 6/1997 | Sump | 2/6.6 |
| 5,806,101 | A | * | 9/1998 | Thurwanger et al. | 2/424 |
| 5,937,439 | A | * | 8/1999 | Barthold et al. | 2/10 |
| 5,950,888 | A | * | 9/1999 | Nolan-Brown | 224/172 |
| 6,260,204 | B1 | * | 7/2001 | Morrissey | 2/172 |
| 2004/0060100 | A1 | * | 4/2004 | Reiterman | 2/422 |

FOREIGN PATENT DOCUMENTS

| | | |
|---|---|---|
| DE | 8714490 U1 | 9/1988 |
| DE | 19721146 A1 | 11/1998 |
| FR | 1345651 | 12/1963 |
| FR | 1 394 135 | 2/1964 |
| FR | 2 846 523 | 5/2004 |

* cited by examiner

*Primary Examiner* — Shaun R Hurley
*Assistant Examiner* — Jane S Yoon
(74) *Attorney, Agent, or Firm* — McGlew and Tuttle, P.C.

(57) ABSTRACT

A safety helmet (1) has a circumferential module ring (2), made especially of a thermoplastic plastic. The module ring (2), has a plurality of plug-in slots (3), which are located at spaced locations from one another in the direction of the module ring (2). This provides standardized simultaneous mounting possibilities for various functional accessories with plug elements complementary to the plug-in slots (3).

20 Claims, 3 Drawing Sheets

FIG. 2A
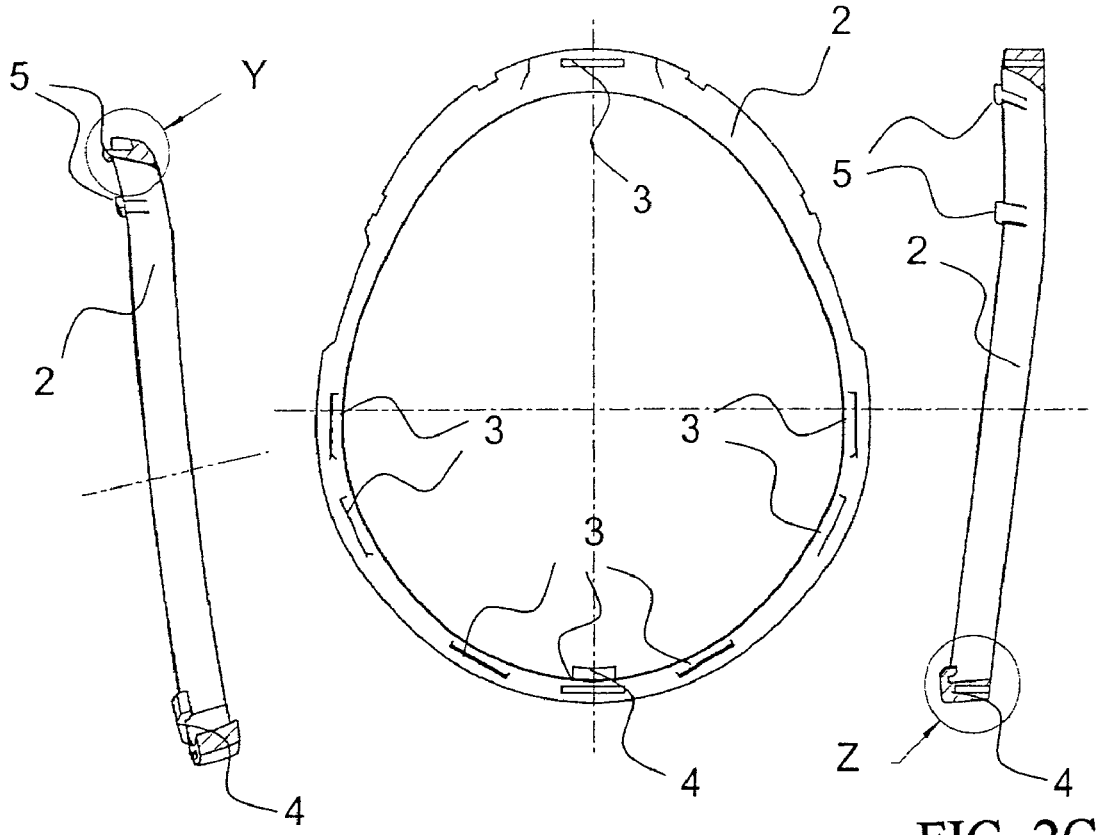
FIG. 2B
FIG. 2C
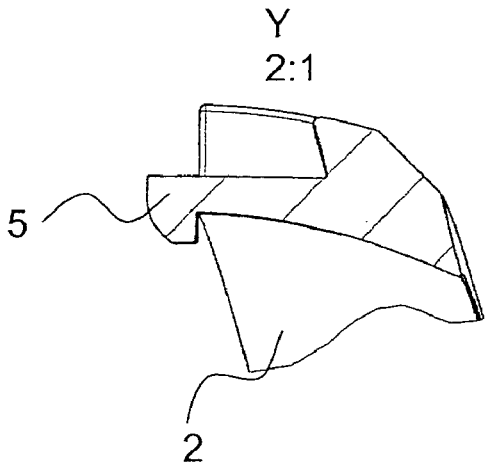
FIG. 2D
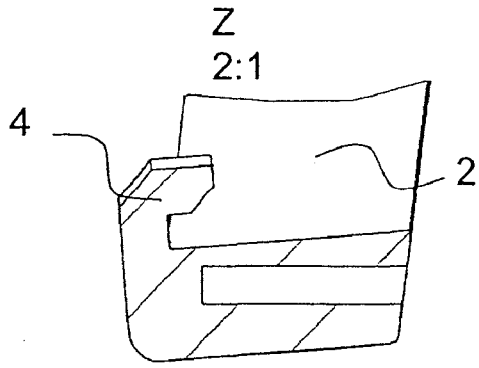
FIG. 2E

SAFETY HELMET WITH MODULE RING

CROSS REFERENCE TO RELATED APPLICATIONS

This application claims the benefit of priority under 35 U.S.C. §119 of German Patent Application DE 10 2005 024 507.2 filed May 27, 2005, the entire contents of which are incorporated herein by reference.

FIELD OF THE INVENTION

The present invention pertains to a safety helmet with a module ring.

BACKGROUND OF THE INVENTION

Safety helmets are known especially as fireman helmets, industrial safety helmets, mountain climber helmets or also military helmets. Depending on the application, e.g., in the area of fire departments, a large number of different functional accessories are necessary, which must be mounted on the safety helmet, for example, communications elements, such as two-way sets for radio sets, lights or visors for protecting the user of the helmet. The adapter systems for mounting depend on both the manufacturer of the helmet and the manufacturer of the accessories. The adapters used hitherto are fastened either by means of screw connections in prefabricated holes on the helmet or by means of a fixing screw at the edge of the helmet. Standardized connections between functional accessories and the helmet have hitherto been only individual solutions for a certain functional element or they provide for mounting different accessories by a single connection site at a single point on the helmet. A uniform adapter system is known for industrial safety helmets only with integrally injection-molded plug-in pockets for visors and capsule type ear protectors left and right over the ears.

The publication FR 1 345 651 A shows a safety helmet with a circumferential metallic spring band and, again, with screwed fastening means for receiving individual functional elements.

SUMMARY OF THE INVENTION

Accordingly, the object of the present invention is to provide a safety helmet with a simultaneous, uniform possibility of mounting different functional accessories in selected positions.

According to the invention, a safety helmet is provided with a circumferential module ring with a plurality of plug-in slots located at spaced locations in the longitudinal direction of the module ring for receiving functional accessories.

The essential advantage of the safety helmet according to the invention is that the circumferential module ring, which is preferably made in one piece from a duroplastic or thermoplastic plastic, is equipped with a plurality of plug-in slots provided for the simultaneous mounting of different functional accessories and can thus practically be used for a plurality of applications.

The plug-in slots may be arranged obliquely in said module ring. The plug-in slots may be continuous from top to bottom or may be not continuous.

The module ring may be provided with at least one hooking element and with elastic clamping elements for the detachable fastening of the module ring at the lower edge of the safety helmet, especially at openings in the helmet shell. At least one of the hooking elements and the clamping elements may be integral parts of the module ring. The clamping elements and the at least one the hooking element may be arranged on opposite sides of the module ring.

The plug-in slots may be equipped with receiving snap-in elements for cooperating with complementary snap-in elements of the functional accessories, so that the functional accessories are detachably fixed in the plug-in slots.

The module ring may consist of a duroplastic or thermoplastic plastic. The inner surface of the module ring may be adapted to the contour of the safety helmet.

The functional accessories may comprise one or more of the following functional elements for mounting in the plug-in slots: Visors, eyeglass straps, capsule type air protectors, breathing mask adapters, lights, infrared or video cameras, power supply sources, badges, tools, communications elements, and head-up display.

The module ring may be colored or marked in color.

The module ring may advantageously be connected, especially integrally injection molded to the safety helmet. The module ring may contain a cable duct, power sources and/or electronic components, especially an antenna, radio transmitters, microphones, sensors, lamps and/or lights. The module ring can be connected to a neck protector.

An exemplary embodiment of the present invention will be explained by means of the figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 2A is a bottom view of the safety helmet of FIG. 1;

FIG. 2B is a sectional detail of one side of the module ring;

FIG. 2C is a sectional detail of another side of the module ring;

FIG. 2D is a sectional detail Y of FIG. 2C;

FIG. 2E is a sectional detail Z of FIG. 2D; and

DESCRIPTION OF THE PREFERRED EMBODIMENTS

Figures 1A, 1B, 1C:
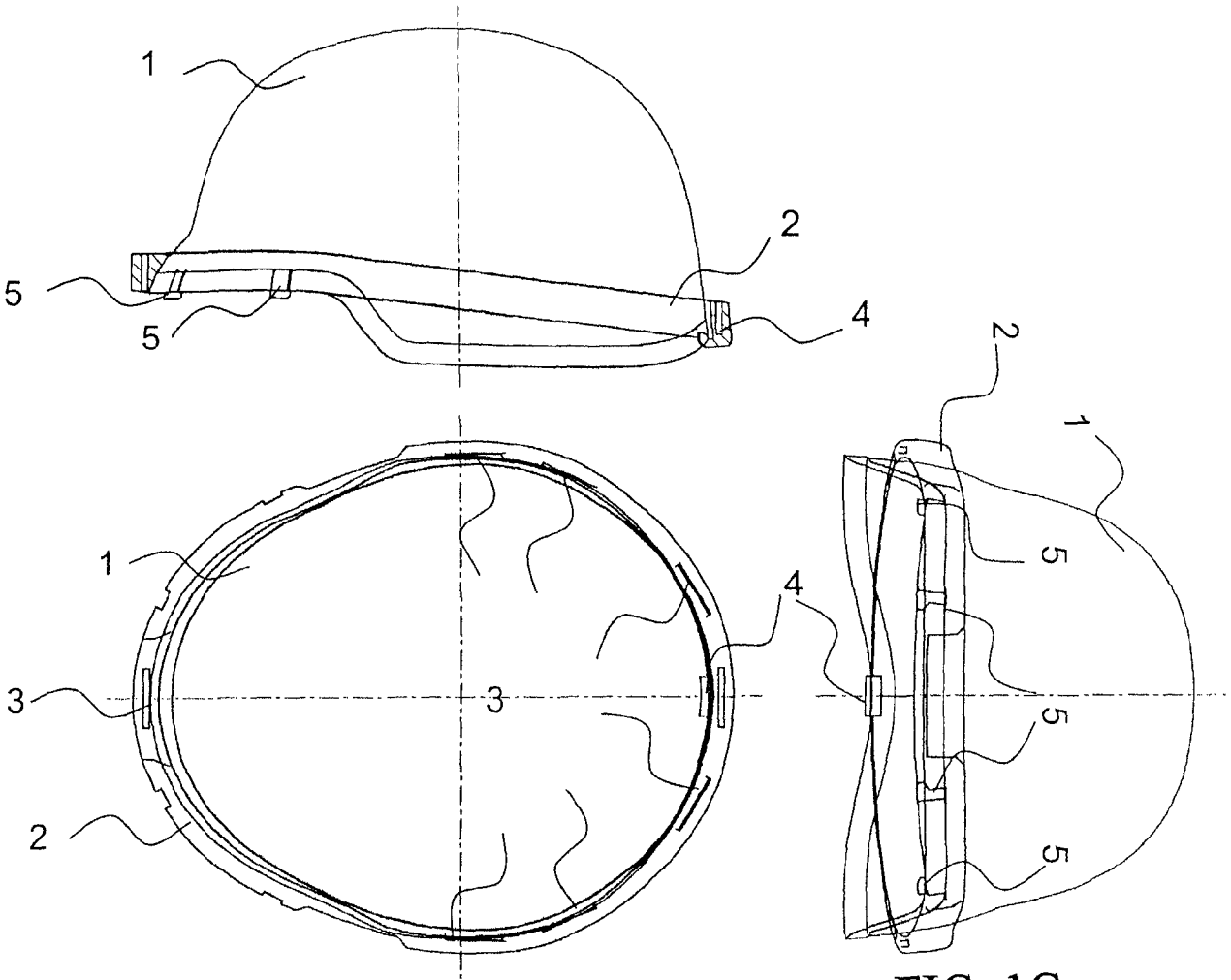
FIG. 1A is a side partially sectional view of a safety helmet with a module ring according to the invention.
FIG. 1B is a top view of the safety helmet of FIG. 1A.
FIG. 1C is a front view of the safety helmet of FIG. 1A.

Referring to the drawings in particular, a helmet shell (known in itself) of a safety helmet 1, suitable for different applications, is shown in FIG. 1A-1C. The outer circumference of the safety helmet 1 decreases from bottom to top, i.e., it has a conical shape.

The module ring 2 with a plurality of plug-in slots 3 is preferably manufactured in one piece from a duroplastic or thermoplastic plastic. As an alternative, the module ring 2 is manufactured from diecast aluminum. The inner surface of the module ring 2 is adapted to the contour of the safety helmet 1 such that the module ring 2 will be seated tightly in a defined position when it is put on the safety helmet 1.

The module ring 2 can be detachably fastened to the safety helmet 1 by means of the integral elements of the module ring 2, which are shown in detail in FIGS. 2A-E, namely, at least one hooking element 4, which extends under the edge of the safety helmet 1 on one side of the helmet, for example, in the back, and by means of a plurality of elastic clamping elements 5, which are arranged on the opposite side of the module ring 2 and consequently of the safety helmet 1. Thus, the module ring 2 cannot become accidentally detached from the protective helmet in the upward direction.

The plug-in slots 3 shown are preferably designed such that they are continuous from top to bottom, so that suitable functional accessories such as visors, eyeglass straps, capsule type ear protectors, breathing mask adapters, lights, infrared or video cameras, power supply sources such as batteries, badges, tools and mechanical aids such as wedges, can be plugged into the plug-in slots 3 either from the top or from the bottom, such as communications elements (microphone, loudspeaker). The functional accessory has plug type elements, which fit the plug-in slots 3. The wall of the plug-in slots 3 is preferably provided with receiving snap-in elements, for example, round openings, which cooperate with complementary snap-in elements, i.e., for example, detents, knobs or pin-shaped formations, on the plug elements of the functional accessories to be plugged in. As a result, the functional accessories are fixed in the plug-in slots 3 detachably but in a defined manner.

Figure 3:
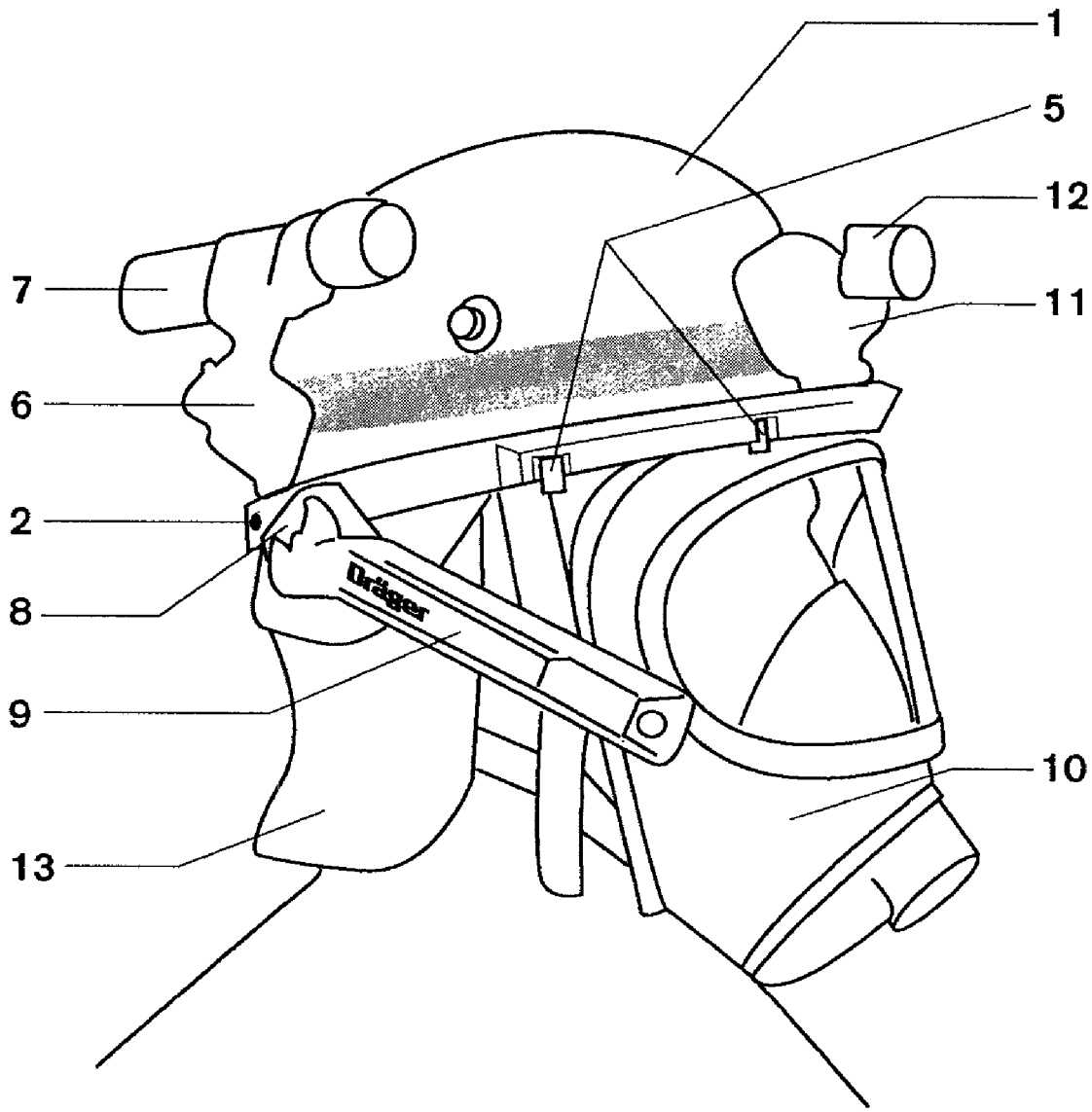
FIG. 3 is a side view of a safety helmet with a module ring with an exemplary functional accessory plugged onto it.

FIG. 3 shows a view of a safety helmet 1 with an attached and fixed module ring 2 with functional accessories plugged into plug-in slots 3. The following is shown here as an example:

An attached light holder 6 with a flashlight 7, a plug-in pocket 8 with a breathing mask adapter 9 for a breathing mask 10. An attached universal holder 11 is used here as a holder for an infrared camera 12. Furthermore, the module ring 2 can be connected to a neck protector 13.

In a special embodiment, the module ring 2 is marked in color by coloring during manufacture or by subsequent painting, applying a sticker or covering in order to highlight a function or quality labeling of the user of the helmet.

The number and the size of the plug-in slots 3 depend on the number and the type of the functional accessories used as well as the number of the necessary connection points between the functional accessories and the helmet. The dimensions of the plug-in slots 3 are preferably standard in order to guarantee standardization for mounting different functional accessories that have fitting, complementary plug elements.

The module ring 2 may contain a cable duct as well as electronic elements, for example, an antenna, radio transmitter, microphones, sensors, lamps and/or lights.

While specific embodiments of the invention have been shown and described in detail to illustrate the application of the principles of the invention, it will be understood that the invention may be embodied otherwise without departing from such principles.

What is claimed is:

1. A safety helmet, comprising:

a helmet shell comprising a peripheral edge surface; and a circumferential module ring with a plurality of plug-in slots located at spaced locations along said module ring for receiving functional accessories, said circumferential module ring including at least one hooking element and elastic clamping elements for the detachable fastening of said module ring at the lower edge of said safety helmet shell at openings in said helmet shell for connecting said module ring to said helmet shell with said circumferential module ring extending annularly around said helmet shell and said plurality of plug-in slots located at spaced locations along said module ring and disposed at spaced locations extending about a periphery of said helmet shell, said peripheral edge surface defining said openings, wherein at least one of said openings receives one of said elastic clamping elements, said at least one hooking element being provided on one side of said module ring, said elastic clamping elements being provided on an opposite side of said module ring.

2. A safety helmet in accordance with claim 1, wherein said plug-in slots are arranged obliquely in said module ring, each of the plug-in slots being located radially outwardly of said peripheral surface of said helmet shell.

3. A safety helmet in accordance with claim 1, wherein said plug-in slots are continuous from top to bottom.

4. A safety helmet in accordance with claim 1, wherein said plug-in slots have a bottom and are not continuous from top to bottom.

5. A safety helmet in accordance with claim 1, wherein said hooking element and said clamping elements are integral parts of said module ring, one or more of said clamping elements being provided at a front portion of said module ring, said at least one hooking element being provided at a rear portion of said module ring, said front portion being connected to a front portion of said helmet shell via said one or more clamping elements, said rear portion being connected to a rear portion of said helmet shell via said at least one hooking element, one or more of said openings being provided at said front portion of said helmet shell.

6. A safety helmet in accordance with claim 1, wherein said plug-in slots have receiving snap-in elements for cooperating with complementary snap-in elements of a functional accessory, so that the functional accessory is detachably fixed in a corresponding said plug-in slot.

7. A safety helmet in accordance with claim 1, wherein said module ring consists of a duroplastic or thermoplastic plastic and an inner surface of said module ring is adapted to a contour of said helmet shell.

8. A safety helmet in accordance with claim 1, wherein said functional accessories each comprise mounting means for mounting in said plug-in slots and comprise any one of a visor, eyeglass strap part, capsule type air protector, breathing mask adapter, light, infrared or video camera, power supply source, badge, tool, communications element, and head-up display.

9. A safety helmet in accordance with claim 1, wherein said module ring is colored or marked in color.

10. A safety helmet in accordance with claim 1, wherein said module ring comprises a cable duct, power source/electronic components and one or more of an antenna, a radio transmitter, a microphone, a sensor, a lamp and/or light.

11. A safety helmet in accordance with claim 1, wherein said functional accessories each comprise mounting means for mounting in said plug-in slots and at least one of said functional accessories comprises a neck protector.

12. A safety helmet, comprising:

a helmet shell;

a circumferential module ring including connection means for connecting said circumferential module ring to said helmet shell in a position extending annularly and fully around said helmet shell, said circumferential module ring comprising a plurality of plug-in slots located at spaced locations in a circumferential direction of said module ring and with said circumferential module ring extending annularly around said helmet shell, said plurality of the plug-in slots being located at spaced locations about said helmet shell with each of the plug-in slots being located radially outwardly of a peripheral surface of said helmet shell, said connection means of said module ring comprising at least one hooking element and elastic clamping elements for the detachable fastening of said module ring at the lower edge of said safety helmet shell at openings in said helmet shell, said circumferential module ring comprising an inner module ring side and an outer module ring side, said inner module ring side being opposite said outer module ring side, said at least one hooking element being provided on said inner module ring side, said elastic clamping elements being provided on said outer module ring side; and a functional accessory having a portion shaped for being received in one of said plurality of the plug-in slots.

13. A safety helmet in accordance with claim 12, wherein said hooking element and said clamping elements are integral parts of said module ring, said module ring having a front circumferential portion and a rear circumferential portion, said front circumferential portion being located opposite said rear circumferential portion, one or more of said elastic clamping elements being provided on said front circumferential portion, said at least one hooking element being provided on said rear circumferential portion, said helmet shell having a helmet shell front portion and a helmet shell rear portion, said helmet shell front portion being connected to said front circumferential portion via said one more of said elastic clamping elements, said helmet shell rear portion being connected to said rear circumferential portion via said at least one hooking element.

14. A safety helmet in accordance with claim 12, wherein said plug-in slots have receiving snap-in elements for cooperating with complementary snap-in elements of said functional accessory, so that said functional accessory is detachably fixed in a corresponding said plug-in slot.

15. A safety helmet in accordance with claim 12, wherein said module ring consists of a duroplastic or thermoplastic plastic and an inner surface of said module ring is adapted to a contour of said helmet shell.

16. A safety helmet in accordance with claim 12, wherein said functional accessory comprises mounting means for mounting in said plug-in slots and is one of a visor, eyeglass strap part, capsule type air protector, breathing mask adapter, light, infrared or video camera, power supply source, badge, tool, communications element, and head-up display.

17. A safety helmet in accordance with claim 12, wherein said module ring is colored or marked in color.

18. A safety helmet in accordance with claim 12, wherein said connection means comprises an integrally injection molding of said helmet shell to said module ring.

19. A safety helmet in accordance with claim 12, wherein said module ring comprises a cable duct, power source/electronic components and one or more of an antenna, a radio transmitter, a microphone, a sensor, a lamp and/or light.

20. A safety helmet in accordance with claim 12, wherein said functional accessories each comprise mounting means for mounting in said plug-in slots and at least one of said functional accessories comprises a neck protector.

* * * * *